US007748180B1

(12) United States Patent
Plavidal

(10) Patent No.: US 7,748,180 B1
(45) Date of Patent: Jul. 6, 2010

(54) JOIST STIFFENING SYSTEM

(76) Inventor: Richard W. Plavidal, 11743 County Road 1, Ridgway, CO (US) 81432

( * ) Notice: Subject to any disclaimer, the term of this patent is extended or adjusted under 35 U.S.C. 154(b) by 831 days.

(21) Appl. No.: 11/426,300

(22) Filed: Jun. 23, 2006

Related U.S. Application Data

(60) Provisional application No. 60/694,158, filed on Jun. 23, 2005.

(51) Int. Cl.
*E04C 3/18* (2006.01)
*E04C 3/04* (2006.01)

(52) U.S. Cl. ..... 52/223.8; 52/223.14; 52/223.11; 52/573.1; 52/695

(58) Field of Classification Search ..... 52/223.8, 52/657, 223.11, 223.14, 169.13, 170, 167.3, 52/299, 291, 695, 573.1; 248/317, 343
See application file for complete search history.

(56) References Cited

U.S. PATENT DOCUMENTS

| | | | | | |
|---|---|---|---|---|---|
| 417,383 | A * | 12/1889 | Christ | 256/59 |
| 625,135 | A * | 5/1899 | Babcock et al. | 212/312 |
| 881,232 | A * | 3/1908 | Flatley | 52/657 |
| 1,145,608 | A * | 7/1915 | Morton | 52/291 |
| 1,536,717 | A * | 5/1925 | Krekel | 52/657 |
| 1,850,118 | A * | 3/1932 | Meyers | 52/223.6 |
| 1,979,642 | A * | 11/1934 | Sahlberg | 52/250 |
| 2,126,511 | A * | 8/1938 | Soule | 52/223.6 |
| 2,302,101 | A * | 11/1942 | Boydstun | 52/210 |
| 2,510,958 | A * | 6/1950 | Coff | 52/223.8 |
| 2,637,421 | A * | 5/1953 | Wolfard | 52/640 |
| 2,653,553 | A * | 9/1953 | Jacobs | 52/641 |
| 2,675,695 | A * | 4/1954 | Coff | 52/223.8 |
| 2,837,783 | A * | 6/1958 | Smirnoff | 52/657 |
| 2,856,646 | A * | 10/1958 | Latimer et al. | 52/223.6 |
| 3,084,481 | A * | 4/1963 | Silberkuhl et al. | 52/223.8 |
| 3,398,498 | A * | 8/1968 | Krauss | 52/691 |
| 3,538,653 | A * | 11/1970 | Meckler | 52/1 |
| 3,940,892 | A * | 3/1976 | Lindbergh | 52/86 |
| 4,261,149 | A * | 4/1981 | Gustafson | 52/292 |
| 4,308,700 | A * | 1/1982 | Romig, Jr. | 52/223.8 |
| 4,441,289 | A * | 4/1984 | Ikuo et al. | 52/167.1 |
| 4,706,436 | A * | 11/1987 | Mabey et al. | 52/645 |
| RE34,103 | E * | 10/1992 | Mabey et al. | 52/645 |
| 5,337,531 | A * | 8/1994 | Thompson et al. | 52/640 |
| 5,371,983 | A * | 12/1994 | Kawaguchi et al. | 52/81.1 |
| 5,383,749 | A * | 1/1995 | Reisdorff et al. | 405/232 |
| 5,588,270 | A * | 12/1996 | Keating | 52/291 |
| 5,671,572 | A * | 9/1997 | Siller-Franco | 52/223.8 |
| 5,881,514 | A * | 3/1999 | Pryor | 52/223.8 |
| 6,065,257 | A * | 5/2000 | Nacey et al. | 52/223.8 |
| 6,240,695 | B1 * | 6/2001 | Karalic et al. | 52/690 |
| 6,345,484 | B1 * | 2/2002 | Oliver et al. | 52/702 |
| 6,354,056 | B1 * | 3/2002 | Korzen | 52/712 |
| 6,385,921 | B1 * | 5/2002 | Evans | 52/169.9 |
| 6,389,766 | B1 * | 5/2002 | Jackson | 52/291 |
| 6,892,410 | B2 * | 5/2005 | Tokuno et al. | 14/14 |
| 6,892,504 | B1 * | 5/2005 | diGirolamo et al. | 52/657 |
| 6,920,724 | B1 * | 7/2005 | Hundley | 52/167.3 |
| 7,107,730 | B2 * | 9/2006 | Park | 52/223.8 |
| 7,305,802 | B1 * | 12/2007 | Plavidal | 52/291 |
| 2002/0194808 | A1 * | 12/2002 | Ratliff | 52/633 |

* cited by examiner

*Primary Examiner*—Phi Dieu Tran A
(74) *Attorney, Agent, or Firm*—Crossley Patent Law; Mark A. Crossley

(57) ABSTRACT

A system for stiffening members such as joists, beams, trusses, and other like supporting members, the system affected by pre-tensioning. The system is offered in a plurality of embodiments for various applications provided little or no clearance below members. A corner brace embodiment is also provided.

1 Claim, 16 Drawing Sheets

JOIST STIFFENING SYSTEM

BACKGROUND OF THE INVENTION

Floor squeaks have long been a problem, with attempted solutions offered to date being more symptom relief approaches, rather than addressing the underlying problem. Flexion of floor joists is typically the problem. Even though joists utilized meet code requirements, they are typically not strong enough to provide quiet and stable floors. Another issue is that existing wiring and plumbing installed through and around floor joists make adding extra joists impossible. Adding more wood to existing joists does not substantially increase joist stiffness and requires not only considerable effort but also the space needed to do so. Further, floor joists typically exist in limited space environments not conducive to additional materials or working freedom. Obstacles such as heating ducts, plumbing, wiring, and the like further hinder joist access. Bonding a floor or sub-floor to the joists below can often prevent squeaks but does nothing to prevent joists flexion.

Invasion from above a joist, as in through a floor or sub-floor is especially undesirable or even practically impossible when floor covering is already applied to flooring. Equally important is that a stiffening apparatus is often impractical or even impossible due to a lack of clearance below the member needing added stiffness.

Pre-tensioning is the key element needed and is important for effective floor stiffening because floor deflection typically occurs only over several tens of thousandths of an inch. Small gaps or any free play between a stiffening system and the floor unit would eliminate any potential benefit. Pre-tensioning eliminates any possible free play and is also useful for fixing sags or warped joists.

What is needed is a joist stiffening system that is compact, lightweight and easy to install, adapts to various clearance problems, and offers basic pre-tensioning capability for increasing the stiffness of a joist, header, or other member, thereby preventing flexion and movement. For these needs, a plurality of pre-tensioning embodiments is needed.

The joist stiffening system is not relegated to use only with floor joists. The apparatus can be used in a multitude of applications wherein a horizontal or even diagonally disposed support member requires added stiffness. Applications may include roofs, garage doors, trusses, or virtually any horizontally or diagonally disposed member needing added stiffness.

By providing a plurality of embodiments of the joist stiffening system a variety of situations needing joist stiffening application is accommodated. The embodiments of the pre-tensioning system can be mixed and matched for various stiffening solutions. As pre-tensioning is needed in a variety of situations which provide different clearance and stiffening challenges, the embodiments of the joist stiffening system solves pre-tensioning problems in various problem situations.

FIELD OF THE INVENTION

The invention relates to strengthening joists and eliminating joist and floor sags and squeaks, and more particularly to a pre-tensioning joist stiffening system that attaches to a floor joist or other horizontal or diagonal support member which benefits from added stiffness.

SUMMARY OF THE INVENTION

The general purpose of the joist stiffening system, described subsequently in greater detail, is to provide a joist stiffening system which has many novel features that result in an improved joist stiffening system which is not anticipated, rendered obvious, suggested, or even implied by prior art, either alone or in combination thereof.

To attain this, the joist stiffening system is offered in a plurality of embodiments. The embodiments include what will be termed the Cross Brace system, Corner Brace system, the Modular Integrated system, and the X-Press Truss system. Each embodiment provides pre-tensioning of support members such as trusses, floor joists, and the like whereby added stiffness is provided. Added stiffness results in less or even no significant movement of the support member. Significantly measurable flexion is negated. The examples provide pre-tensioning with zero clearance below a member, substantially zero clearance below the member, or little clearance below the member, as in the corner brace system.

The Cross Brace system embodiment offers joist stiffening that does not extend below the level of a floor joist more than a fraction of an inch. The Cross Brace system can be utilized in several embodiments. The Cross Brace system comprises a perforated bottom strap which is used in conjunction with 2×4's or steel strut elements. The perforated bottom strap is placed across the bottom edges of adjacent joists. The strap is not limited as to the number of joists that may be involved. Two struts are fastened to the lower sides of the floor joists with triangulated brackets having bracket extensions. The extensions provide for fastener attachment. A forming bracket joins the two paired struts. The allthread bolt head is positioned such that the bolt head is above the hole in the forming bracket. The struts are angularly between the adjacent joists. The allthread passes through perforated bottom strap. A pipe washer with tensioning nut is tightened against the strap. The joists are thereby pre-tensioned.

An optional addition includes an additional 2" by 4" board or steel member placed against the bottom of the floor, the ends of the additional 2×4 fastened against each adjacent joist. The angularly fitted struts are fastened to the additional 2×4.

The Cross Brace system shortens the effective span of floor joists by creating an intermediary cross support. This apparatus goes well beyond the role of conventional "blocking" or "cross bracing" floor joists because the pre-tensioned steel strap acts as a continuous beam element. Because of the installation time advantages and effectiveness of this system it may be frequently used in new construction as well.

Another embodiment of the joist stiffening system is referred to as the Modular Integrated truss system. The Modular Integrated system is another essentially zero clearance pre-tensioning system. The Modular Integrated tensioning system comprises more than one variation in examples. Each features the zero clearance pre-tensioning advantage of the system. The primary embodiment of the Modular Integrated system comprises three fundamental parts: angle pre-tensioning members (coming in left and right matching pairs), rigid plate assemblies, and tensioning bolts fitted with nuts and washers. One end of the angle pre-tensioning member is fitted at the top of a joist and against the center rigid steel plate. The rigid plate is fastened to the floor or sub-floor and to the joist. Two more rigid plates are fitted to the side of the joist at each opposite end of the angle steel pre-tensioning members. Each angle pre-tensioning member locks at the receiver attached to the bottom end of the rigid plate. The rigid plates are therefore spaced apart by the horizontal length of the of the angle pre-tensioning members.

Each rigid plate provides a top segment that matches and abuts the angle pre-tensioning member. The rigid plate further comprises a bottom segment with a right angle bend (L)

that extends across the bottom edge of a joist. The rigid plate has two plate L's that further define the rigid plate to resemble a Z. The square tube receiver is permanently affixed to the bottom of the rigid plate and extends slightly beyond the end of the plate. This slight extension serves to hold the angle steel pre-tensioning member in place. An allthread tensioning bolt passes through both square tubes of the rigid plates. Each opposite end of the tensioning bolt is then fitted with a washer followed by a nut. Tightening the nuts pre-tensions the joist.

The primary example of the Modular Integrated system also includes an additional short extension to allow for different length applications. The short extension is another rigid plate but without the square tubing receiver attached to it. A short tensioning bolt holds the two adjacent rigid plates tightly against the short extension. A long section compression member is also included and is fabricated from angle steel. The long section member is made of a horizontal top section with two angled extensions to form a horizontal "K" shaped unit. This long section member is held against the two adjacent rigid plates by a tensioning bolt in similar fashion to the short extension.

An alternative embodiment of the Modular Integrated system is comprised of two rigid plates as described in the primary example. Separating the two plates is a horizontal angle steel pre-tensioning member pushing against the top end of each rigid plate. A tensioning bolt runs horizontally along the bottom edge of the joist and through the square tubing attached along the bottom end of the rigid plates.

The unit is pre-tensioned by tightening the nut and washer assemblies at each end of the tension rod. The over-constraint option of this alternate Modular Integrated system embodiment comprises a third rigid plate fitted between two outer rigid plates. The tensioning bolt is fitted with nuts that are tightened against the outside edges of the receiver on the center rigid plate. A nut is then tightened against each of the outside outer rigid plate tubes, thereby pre-tensioning the joist. The over-constraining feature can be effective in straightening humped or sagging joists.

A second alternative embodiment of the Modular Integrated system comprises a plurality of angle pre-tensioning members and tension strap assemblies. The pre-tensioning members are fastened at an angle along the length of the joist. At or near the center of the joist, the pre-tensioning members are abutted at inside ends to the pre-tensioning member upper joint plate. The other ends of the pre-tensioning members lock underneath the square tubing on each respective tension strap assembly. The tension strap assembly consists of a tension strap which angles upwardly and outwardly along the joist. The inside end of the tension strap is welded to an "L" plate with a square tube fitted along the bottom edge of the joist. A tensioning bolt is passed through each square tube. A nut with washer is tightened against each outer edge of each square tube. The joist is thereby pre-tensioned by tightening the nuts.

A variation of this alternative embodiment incorporates a combination of the immediately above-described embodiment of the Modular Integrated system with a single center rigid plate assembly as described in the primary embodiment.

An alternative embodiment of the Modular system comprises an angle steel with a perpendicularly fastened vertical tension bolt. Each opposing rigid plate is fitted with a tension strap connecting one bottom edge of the rigid plate to the other rigid plate's bottom edge. The tensioning bolt is passed through the tension strap. The tension bolt is tightened from below by a nut against a pipe washer. The pipe washer thereby pre-tensions the tension strap such that the joist is pre-tensioned. The rigid plates are fabricated in such a way that they form a shallow box. The bottom edge of the box is attached to the tension strap while the side and top edges of the box add rigidity. The joist stiffening system can obviously combine any of the system components in providing pre-tensioning for a joist or other such member.

The Modular Integrated system is designed for use in basements or multiple-story applications where preserving space below the floor joist is critical for headroom considerations. It is also ideal for garage door headers or other spanning applications where sagging may be a concern. The Modular Integrated system is configured with multiple design elements so that pre-existing features such as water pipes, wires, ducts, etc. can be avoided. At the same time, the modular design allows for easier handling and installation.

An additional example of the pre-tensioning system is the Corner Brace system. The Corner Brace embodiment applies the pre-tensioning system to corners needing pre-tensioning. An ideal example of the Corner Brace of the system is the meeting of a joist with a foundation or basement wall.

This Corner Brace embodiment of the system allows near indefinite stiffness of the foundation wall to be transferred out along the joist for a distance from the wall, providing two major benefits. First, the floor area directly over the brace is greatly stiffened whereby furniture and other heavy items are securely supported by the floor above the joist. Second, the effective span of the floor joist is reduced, which increases the overall stiffness of the entire floor. The Corner Brace system comprises a joist brace u-channel that is positioned along the bottom of a joist. A wall brace is positioned along an adjacent wall, such as a basement wall or foundation, that is perpendicular and below the joist. The joist brace and the wall brace are perpendicularly joined by a hinge bolt where the joist and wall meet. Another hinge bolt is disposed on opposite outer ends of each of the joist brace and the wall brace. An upper extension of the wall brace extends beyond and above the junction of the joist brace and the wall brace onto the joist. Fasteners are used to attach the extension to the joist. One end of a hat track upper brace is pivotally attached to the hinge bolt at the outer end of the joist brace. One end of a hat track lower brace is pivotally attached to a hinge bolt at the outer end of the wall brace. Opposite ends of the hat track upper and lower braces are then fitted over an allthread bolt via holes in each. The allthread tensioning bolt is first fitted with a nut and a washer. The washer faces the hat track upper and lower braces. The allthread bolt further comprises a half circle cup on an end opposite the hat track brace fitting. The cup fits against the hinge bolt which joins the joist brace to the wall brace. Extending the nut against the washer forces the upper and lower braces outwardly. Outward pressure on the hat track upper and lower braces pre-tensions the junction of the floor joist and wall, thereby stiffening the same.

This Corner Brace system is particularly effective for preventing floor deflections for the first several feet from a wall. This feature is important for situations where tall furniture, such as a cupboard or display cabinet may be prone to rattle or rock when the floor is loaded.

An additional example of the joist stiffening system is referred to as the X-Press system. The X-Press system example of the invention offers joist stiffening that does not extend below the level of a floor joist. As with the other embodiments of the floor joist stiffening system, the X-Press system pre-tensions joists, thereby eliminating lag in the stiffness response to forces applied to the floor.

The X-Press system locates all system components between separate spaced apart, adjacent floor joists. The X-Press system works with most joist spacing combination, such as 2"×12" joists on 12" centers, 2"×8" joists, 2"×10"

joists, and 2"×12" joists on 16" centers, and even wider spaced apart joists. Wider spacing requires only the addition of a short joist section between existing joists. The X-Press transverse stiffening applies a force substantially perpendicular to the floor joists heights, therefore laterally. Stiffening is realized by transferring joist deflection to adjoining joists, as well as reducing effective joist span. Installation is possible by a single installer. Only the basic tools of glue, screwdriver, and a wrench are needed. Further, the X-Press system accommodates I-beam type joists.

The X-Press system requires only that shims be fitted between the X-Press brackets and the narrower section of the I-beam joists. The X-Press system can also be augmented by the optional turnbuckle assemblies which further increase lateral tension between joists.

Thus has been broadly outlined the more important features of the improved joist stiffening system so that the detailed description thereof that follows may be better understood and in order that the present contribution to the art may be better appreciated.

Objects, features and advantages of the improved joist stiffening system will be readily apparent to those of ordinary skill in the art upon reading the following detailed description of presently preferred, but nonetheless illustrative, embodiments of the improved joist stiffening system when taken in conjunction with the accompanying drawings.

In this respect, before explaining the current embodiments of the improved joist stiffening system in detail, it is to be understood that the joist stiffening system is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved joist stiffening system. It is therefore important that the claims be regarded as including such equivalent constructions insofar as they do not depart from the spirit and scope of the joist stiffening system.

It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 18 thereof, the principles and concepts of the joist stiffening system generally designated by the reference number 10 will be described. Varied embodiments of the system 10 will be differentiated by numbers 10A, 10B, 10C, and 10D.

Figure 1:
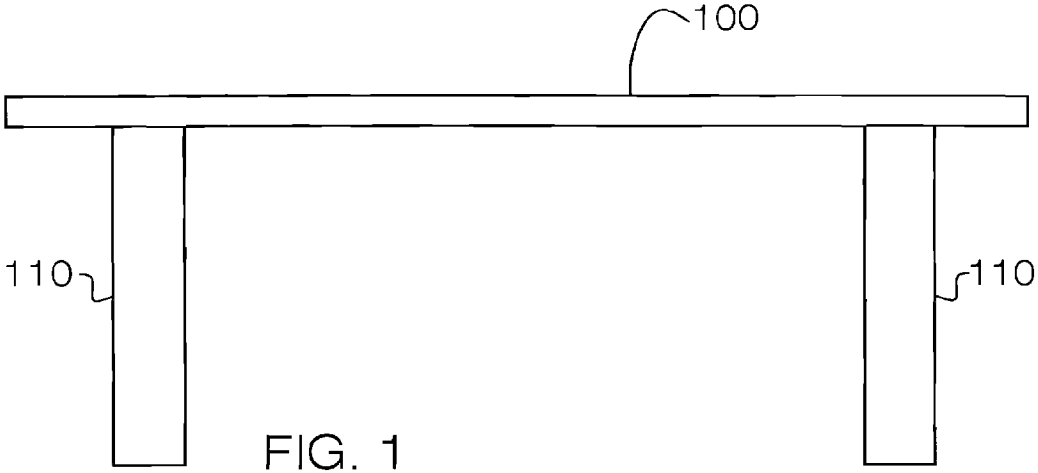
FIG. 1 is an end elevation view of a typical floor with joists.

Referring to FIG. 1, the typical joists 110 and floor/subfloor 100 illustrated are not a part of the system 10. The joists 110 are typical of those needing additional stiffness, as are I-beam joists (not shown).

Referring to FIG. 1, some of the components of the Cross Brace system 10A comprise a pair of struts 20. The forming bracket 24 is fastened to each of an end of the pair of struts. The tensioning bolt 22 extends upwardly from the forming bracket 24. Fasteners 90 secure the forming bracket 24 to the struts 20. Struts 20 may be included in the system 10A or can be cut by a user. A triangulated bracket 26 is secured to each end of one of the struts 20. The triangulated brackets 26 are secured via fasteners 90. The minimal tools 130 needed are represented.

Figure 2:
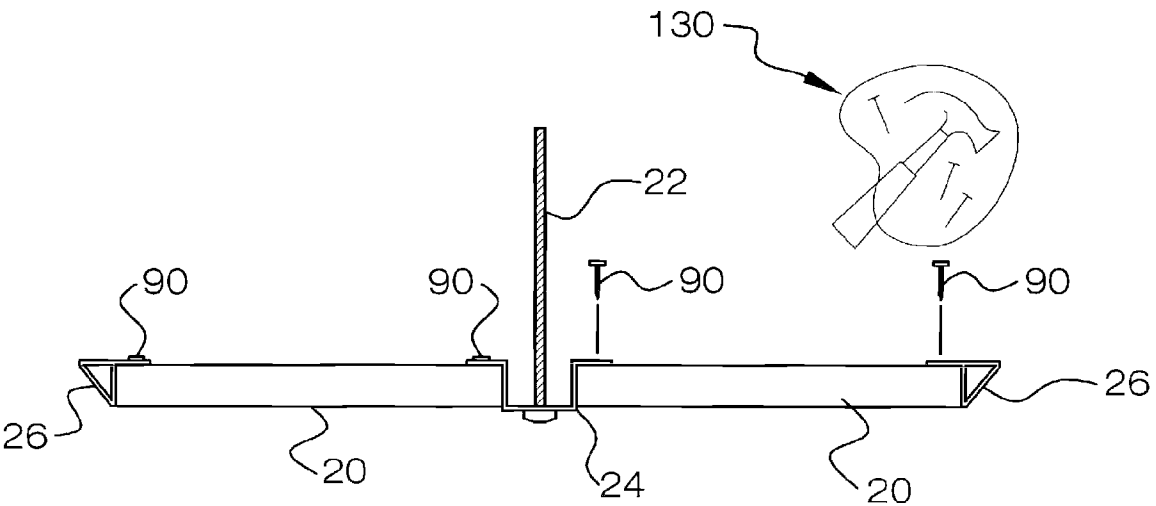
FIG. 2 is a lateral elevation view of components of the Cross Brace system embodiment and tools needed for installation.
Figure 3:
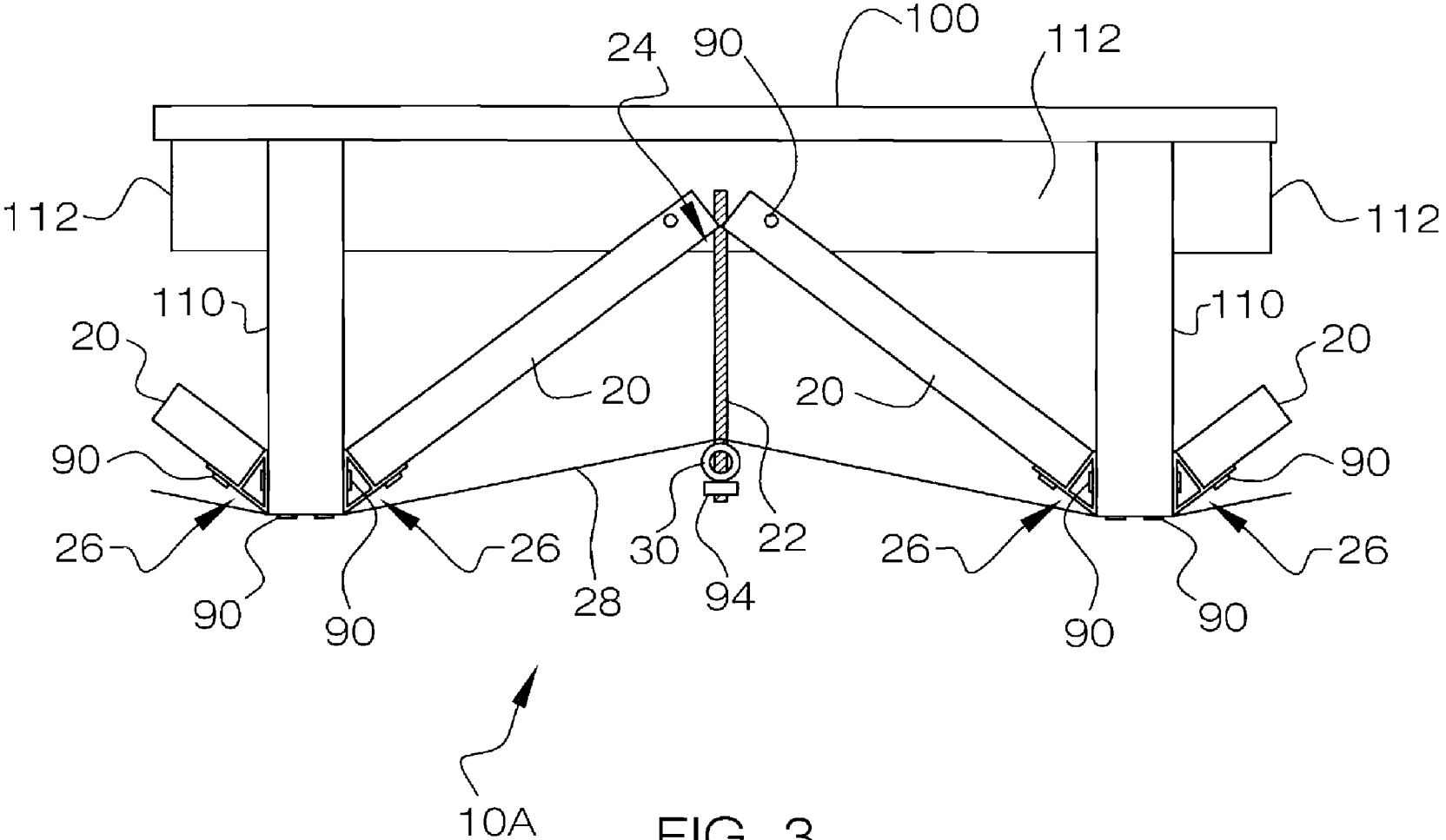
FIG. 3 is lateral elevation view of an embodiment of the Cross Brace system fastened to two adjacent joists and a joist brace.

Referring to FIG. 3, the Cross Brace system 10A is installed between joists 110. A brace 112 is also used in this illustration and is placed against the floor/subfloor 100. The assembled components of FIG. 2 are placed as shown and fastened with fasteners 90 to both the adjacent joists 110 and to the additional brace 112. The top of the struts 20 are fastened to the brace 112 via bolts 90.

The triangulated brackets 26 are fastened to opposing joists 110 to form the triangulated shape of the installed system 10A. The tensioning bolt 22 is anchored to the forming bracket 24 and extends downwardly to pass through the strap 28. The pipe washer 30 is placed around the tensioning bolt 22. The nut 94 is tightened against the pipe washer 30 in order to pre-tension the joists 110. With the leverage provided by the triangulated strut 20 design, little force on the nut 94 is required.

Figure 4:
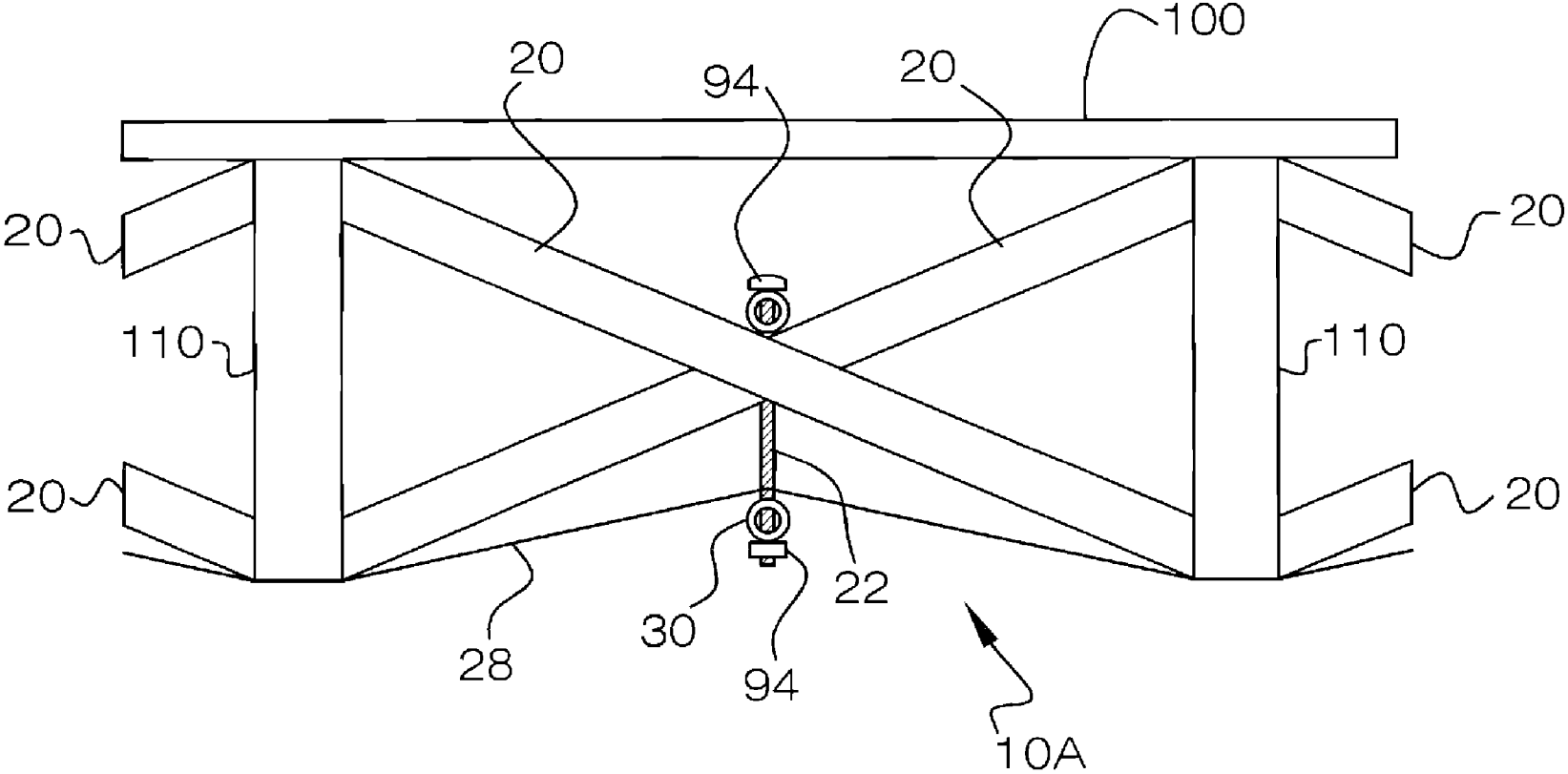
FIG. 4 is a lateral elevation view of an alternate embodiment of the Cross Brace system fastened to adjacent joists.

Viewing FIG. 4, an alternative embodiment of the Cross Brace system 10A utilizes two struts 20 placed in an X pattern and proximal to each other. A top of each strut 20 abuts both the joist 110 and the floor/subfloor 100. The strap 28 is positioned along the bottom of the joists 110. The tensioning bolt 22 is passed through the strap 28 and between the struts 20.

The pipe washer 30 is positioned above the strut 20 junction. A pipe washer 30 is positioned against the bottom side of the strap 28 and tightened by the nut 94. The joists 110 are thereby pre-tensioned.

Referring to FIG. 4, an alternate embodiment of the Cross Brace system 10A uses the hatrack 32 in place of other struts 20. An additional hatrack 32 is positioned between the adjacent joists 110 above the angled hatrack 32. The upper hatrack 32 is fastened to the floor/subfloor 100 via a plurality of fasteners 90 (not shown). The tensioning bolt 22 head 95 is positioned within the upper hatrack 32. The tensioning bolt 22 passed through the angled hatrack 32, thence through the strap 28 positioned below the joists 110. The nut 94 is tightened against the pipe washer 30 to pre-tension the joists 110.

Figure 5:
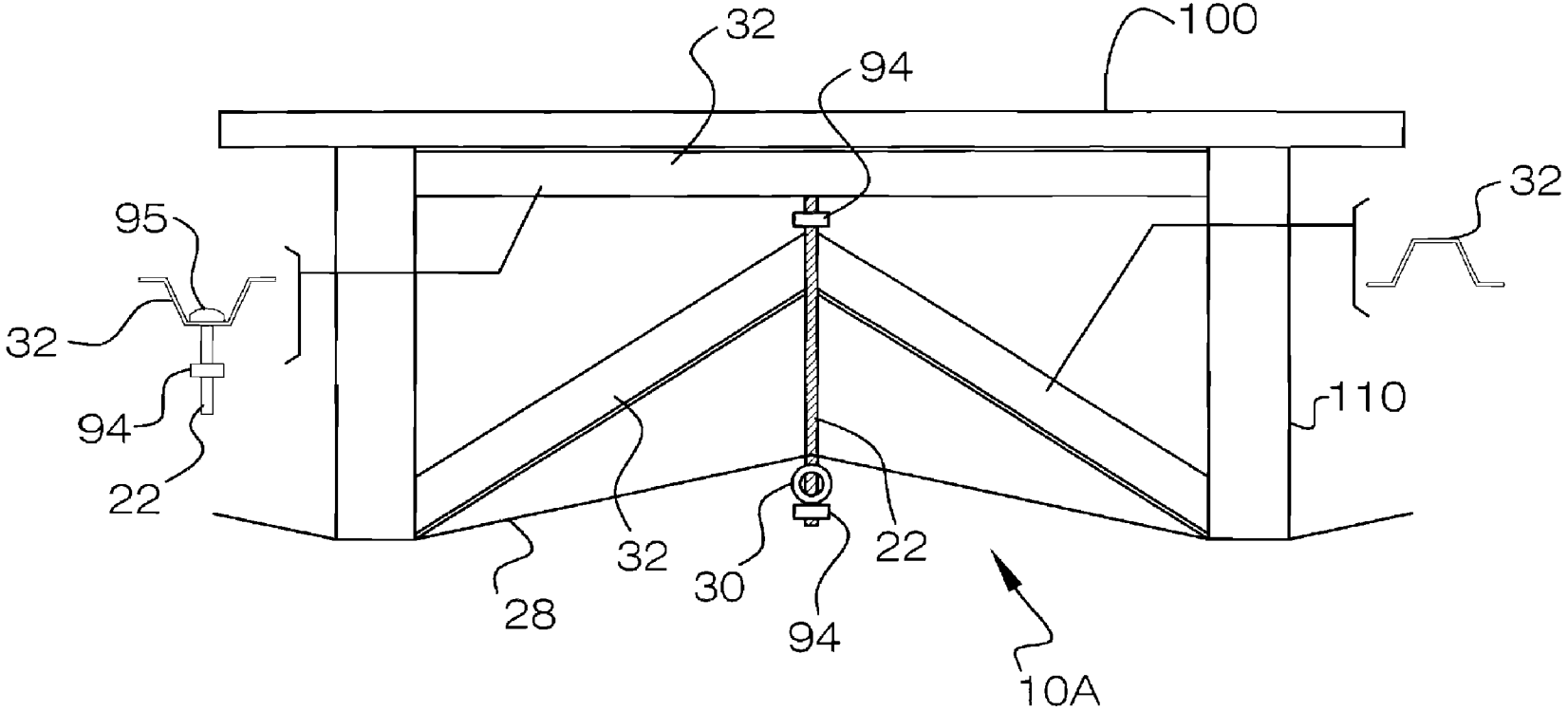
FIG. 5 is a lateral elevation view of an alternate embodiment of the Cross Brace system employing the hat rack component, as installed on adjacent joists.
Figure 6:
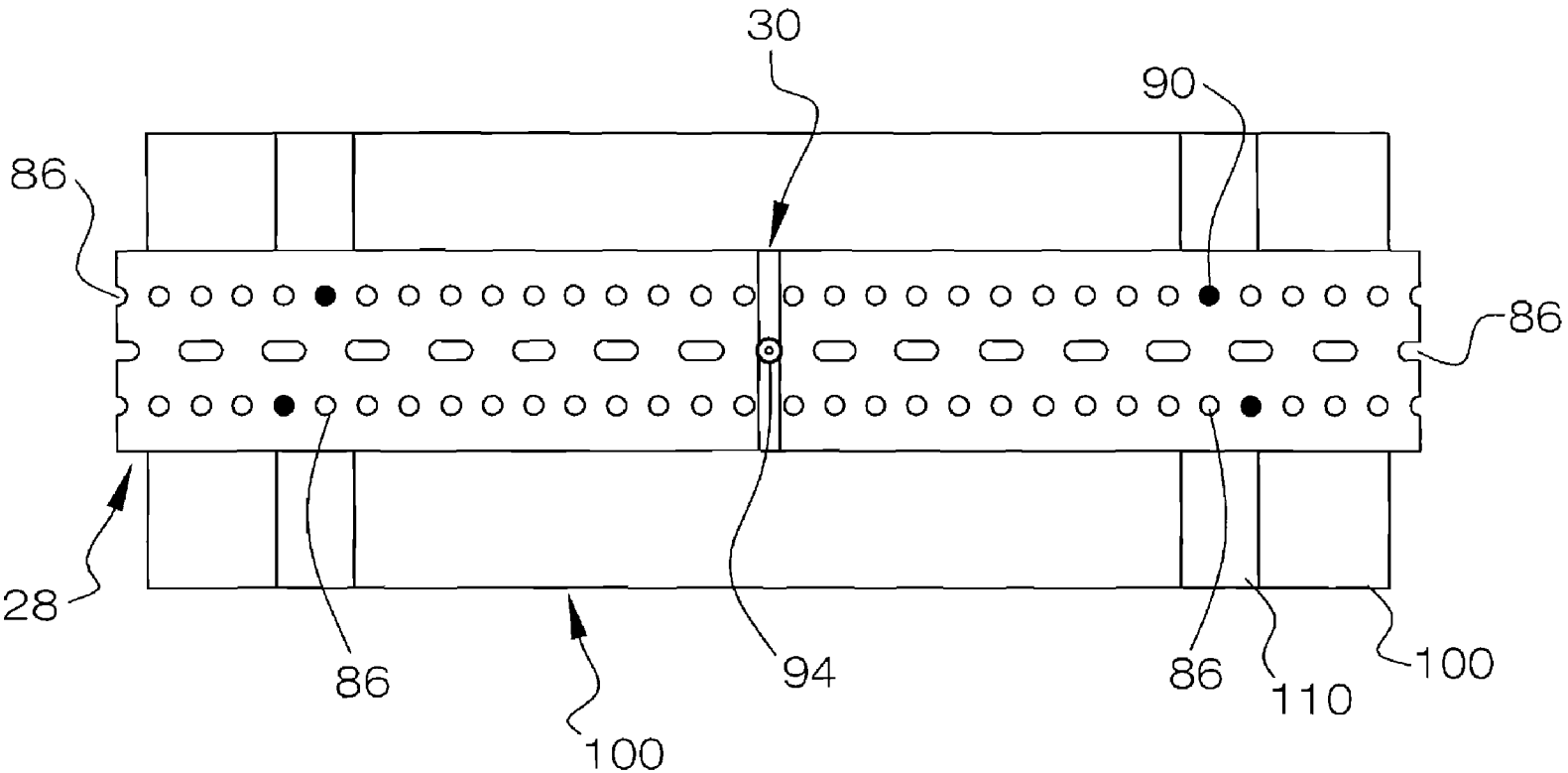
FIG. 6 is a bottom plan view of the cross brace strap used in FIGS. 3, 4, and 5.

Referring to FIG. 6, the strap 28 illustrated in FIGS. 3, 4, and 5 comprises a plurality of holes for locating and fasteners to joists 110 and to the tensioning bolts 22.

Figure 7:
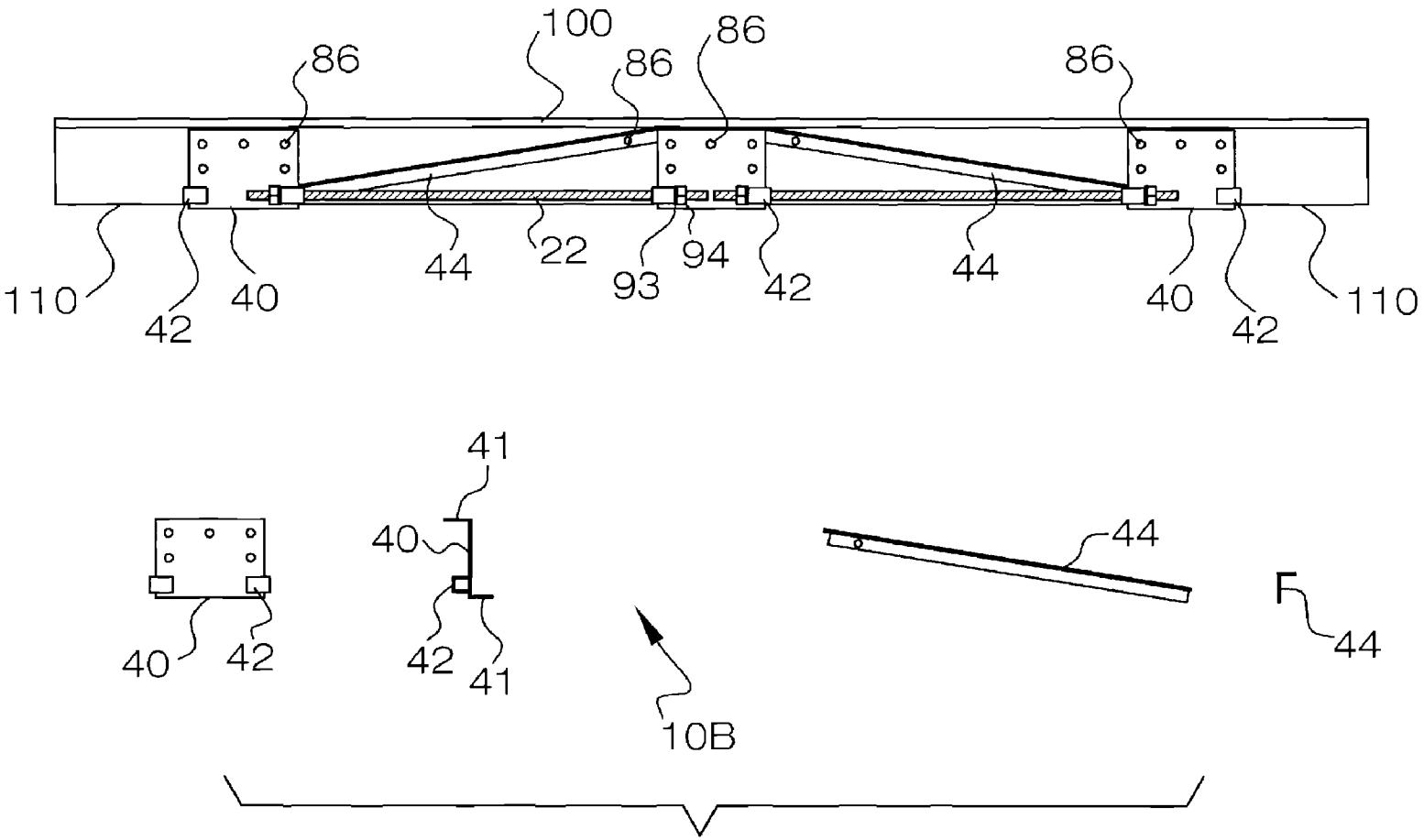
FIG. 7 is lateral elevation view of one embodiment of the Modular Integrated embodiment affixed to a floor/subfloor and joists.

Viewing FIG. 7, the Modular Integrated system 10B is another essentially zero clearance pre-tensioning system 10. The Modular Integrated stiffening system 10B comprises more than one variation in embodiments. Each embodiment provides the zero clearance pre-tensioning advantage of the system 10B. The primary embodiment of the Modular Integrated system 10B comprises three fundamental parts: angle pre-tensioning members 44 (provided in left and right matching pairs), rigid plates 40, and tensioning bolts 22 fitted with nuts 94 and washers 93. One end of each angle pre-tensioning member 44 is fitted at the top of a joist 110 and against the center rigid steel plate 40. The pre-tensioning members 44 are right angle in shape. The rigid plate 40 is fastened to the floor/sub-floor 100 and to the joist 110. Two more rigid plates 40 are fitted to the side of the joist 110 at each opposite end of the angle steel pre-tensioning members 44. Each angle pre-tensioning member 44 locks at the receiver 42 attached to the bottom end of the rigid plate 40. The rigid plates 40 are therefore spaced apart by the horizontal length of the of the angle pre-tensioning members 44. Each rigid plate 40 provides a top segment that matches and abuts the angle pre-tensioning member 44. Each rigid plate 40 further comprises a bottom segment with a right angle bend (L) 41 that extends across the bottom edge of a joist 110. The rigid plate 40 has two plate L's 41 that further define the rigid plate 40 to resemble a Z. The square tube receiver 42 is permanently affixed to the bottom of the rigid plate 40 and extends slightly beyond the end of the plate 40.

This slight extension of the receiver 42 serves to hold the angle steel pre-tensioning member 44 in place. An allthread tensioning bolt 22 passes through both square tube receivers 42 of the rigid plates 40. Holes 86 in the pre-tensioning members 44 provides for fastening to the joist 110. Each opposite end of the tensioning bolt 22 is then fitted with a washer 93 followed by a nut 94. Tightening the tensioning bolt 22 nuts 94 pre-tensions the joist 110. Holes 86 provide for fasteners 90 to attach rigid plates 40 to the joist 110.

Figure 8:
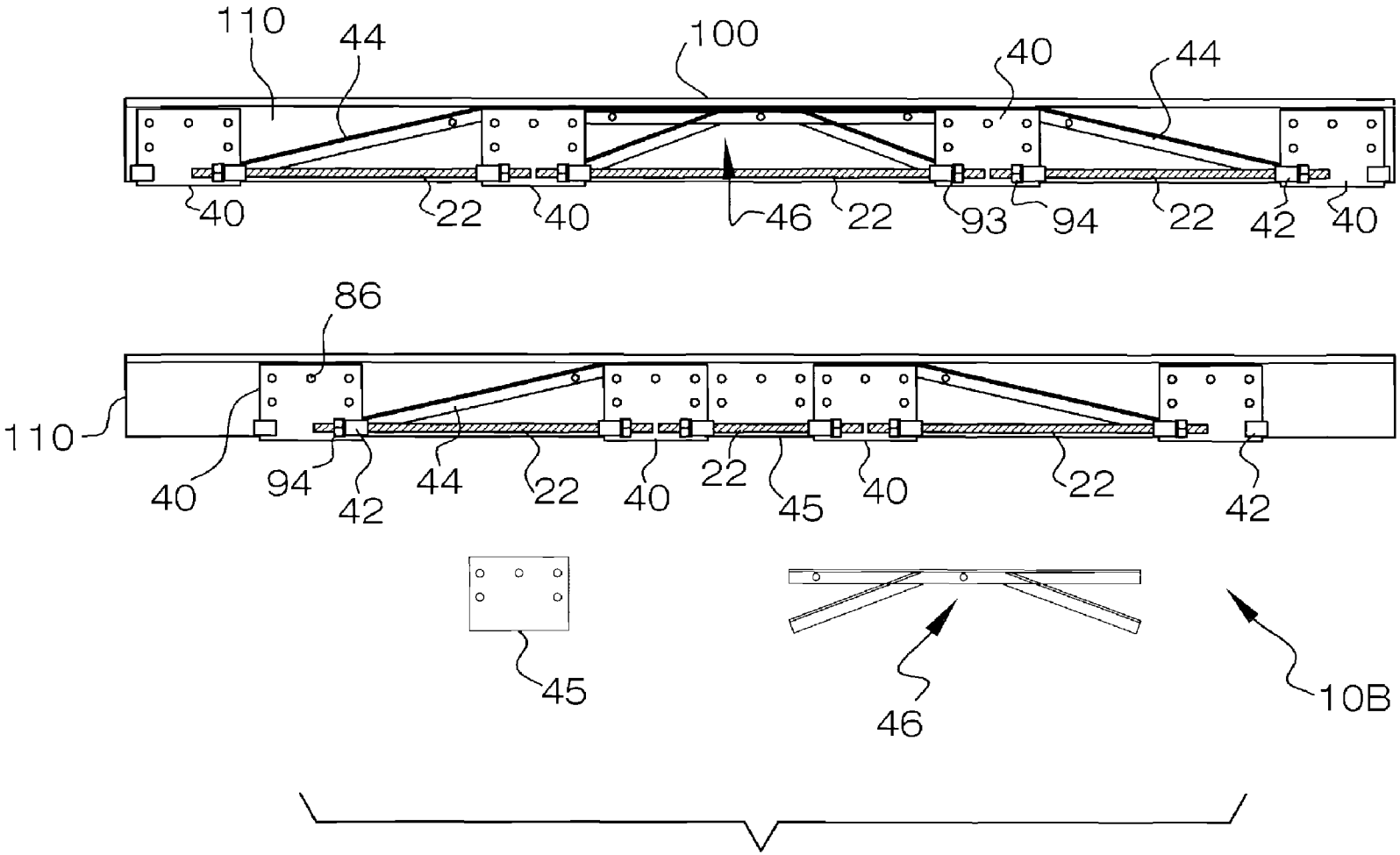
FIG. 8 is a lateral elevation view of two more alternate embodiments of the Modular Integrated system as installed on joists, respectively.

Referring to FIG. 8, the primary embodiment of the Modular Integrated system 10B also includes an additional short extension 45 to allow for different length applications. The short extension 45 is another rigid plate 40 but without the square tubing receiver 42 attached to it. A short tensioning bolt 22 holds the two adjacent rigid plates 40 tightly against the short extension 45. A long section compression member 46 is also included and is fabricated from angle steel. The long section member 46 is made of a horizontal top section with two angled extensions to form a horizontal "K" shaped unit. This long section member 46 is held against the two adjacent rigid plates 40 by a tensioning bolt 22 in similar fashion to the short extension 45.

Figure 9:
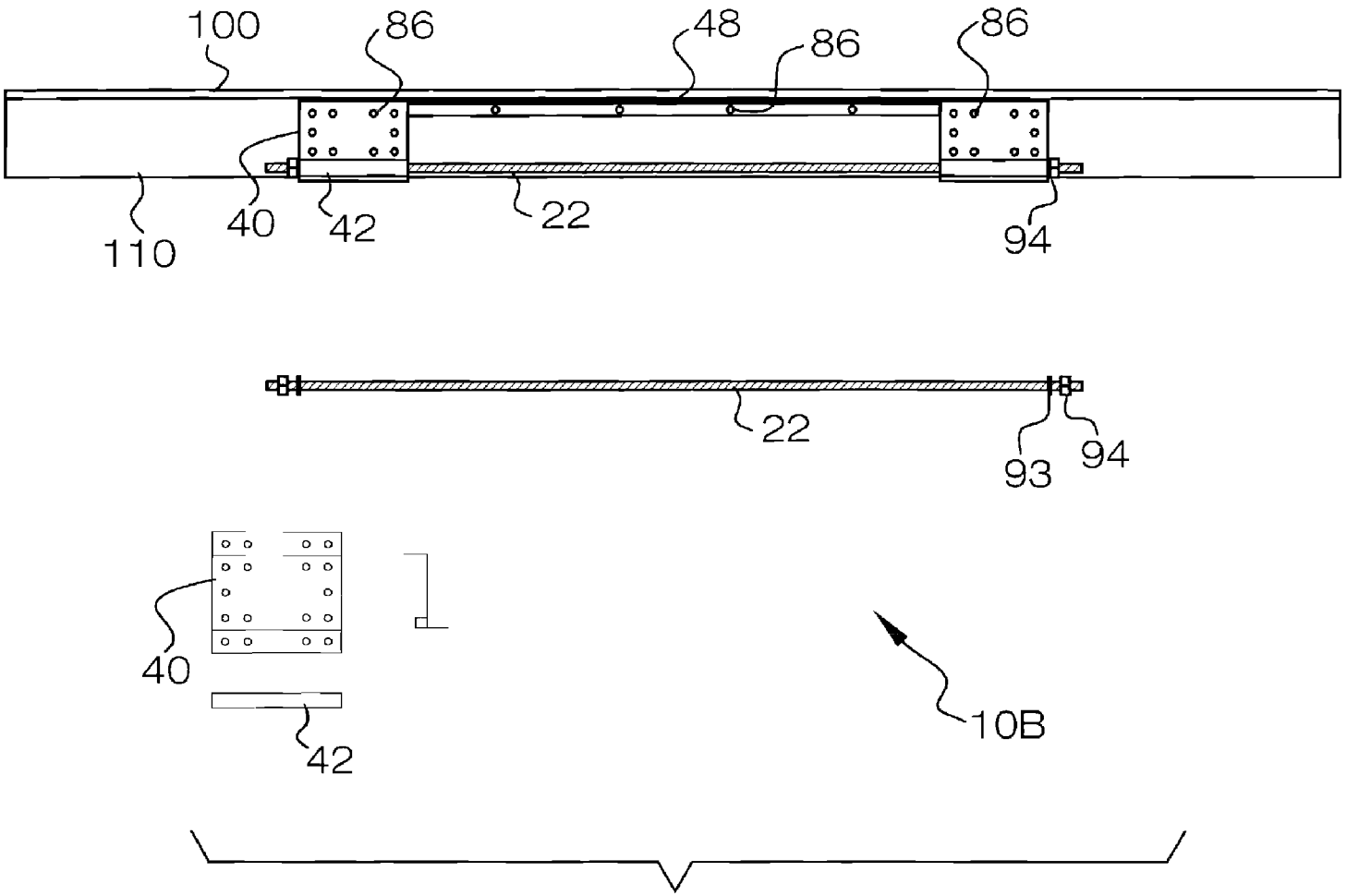
FIG. 9 is a lateral elevation view of an alternate embodiment of the Modular Integrated system installed on a joist.

An alternative embodiment of the Modular Integrated system 10B is illustrated in FIG. 9. This embodiment is comprised of two rigid plates 40 as described in the primary example of the Modular Integrated system 10B. Separating the two plates 40 is a horizontal angle steel compression member 48 pushing against the top end of each rigid plate 40.

A tensioning bolt 22 runs horizontally along the bottom edge of the joist 110 and through the square tubing receivers 42 attached along the bottom end of the rigid plates 40. The system 10B embodiment is pre-tensioned by tightening the nut 94 and washer 93 assemblies at each end of the tensioning bolt 22.

Figure 10:
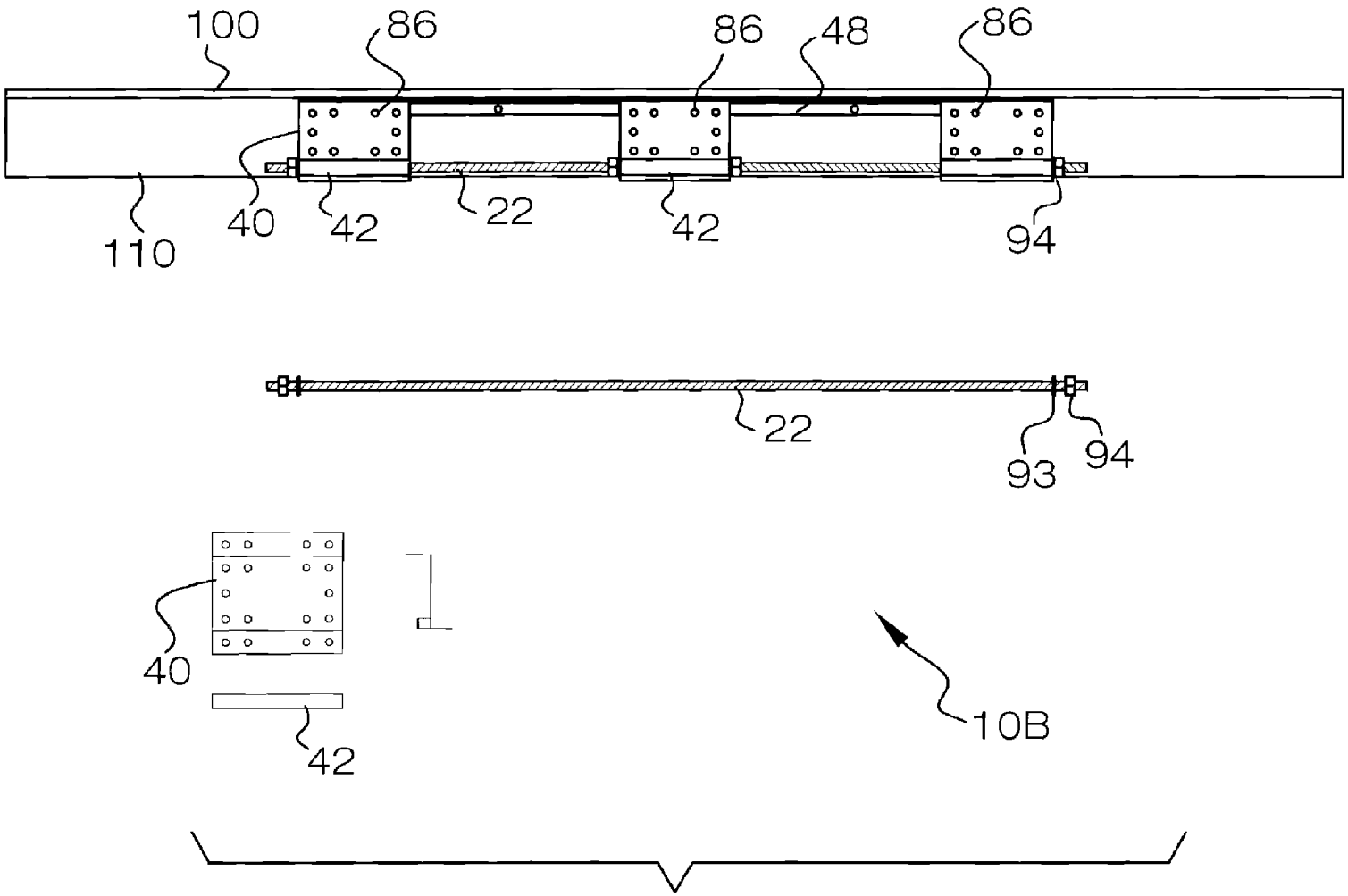
FIG. 10 is a lateral elevation view of an alternate embodiment of the Modular Integrated system installed on a joist.

The over-constraint option of FIG. 10 of an alternate Modular Integrated system 10B embodiment comprises a third rigid plate 40 fitted between two outer rigid plates 40. The tensioning bolt 22 is fitted with nuts 94 that are tightened against the outside edges of the receivers on the center rigid plate 40. A nut 94 is then tightened against each of the outside outer rigid plate 40 receivers 42, thereby pre-tensioning the joist 110. The over-constraining feature can be effective in straightening humped or sagging joists 110.

Figure 11:
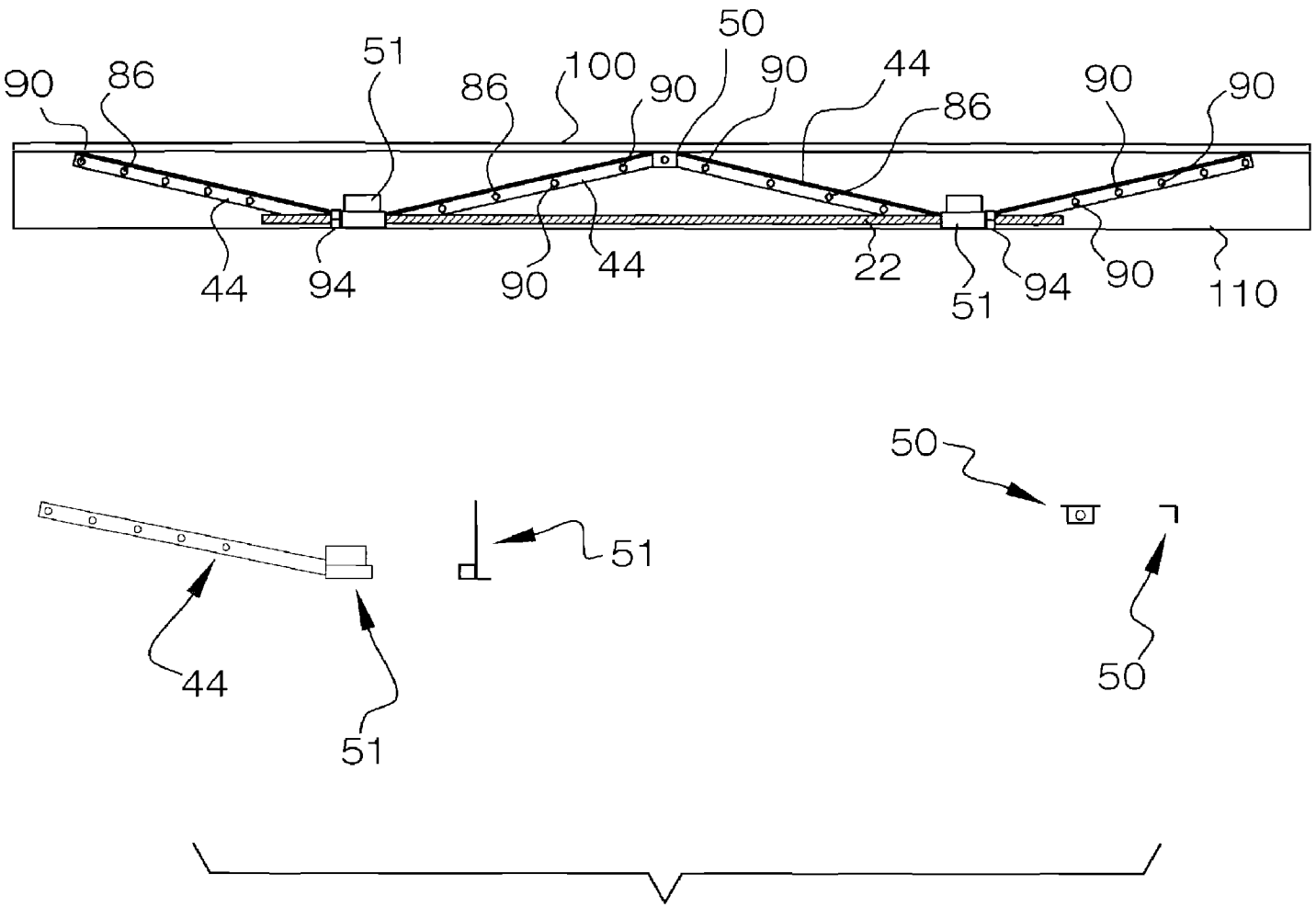
FIG. 11 is a lateral elevation view of an alternate embodiment of the Modular Integrated system installed on a joist.

Another alternative embodiment of the Modular Integrated system 10 B illustrated in FIG. 11 comprises a plurality of angle pre-tensioning members 44. The pre-tensioning members 44 are fastened at an angle along the length of the joist 110 via holes 86 and fasteners 90. At or near the center of the joist 110, the pre-tensioning members 44 are abutted at inside ends to the pre-tensioning member upper joint plate 50. The other ends of the pre-tensioning members 44 lock underneath the square tubing receivers 42 on each respective tube and flange 51. The pre-tensioning members 44 angle upwardly and outwardly along the joist 110. The inside end of the pre-tensioning member 44 is welded to an "L" joint plate 50 with a square tube receiver 42 which is affixed on the bottom edge of the joist 110. The tensioning bolt 22 is passed through each square tube receiver 42.

A nut 94 with washer 93 is tightened against each outer edge of each tube receiver 42. The joist 110 is thereby pre-tensioned by tightening the nuts 94.

Figure 12:
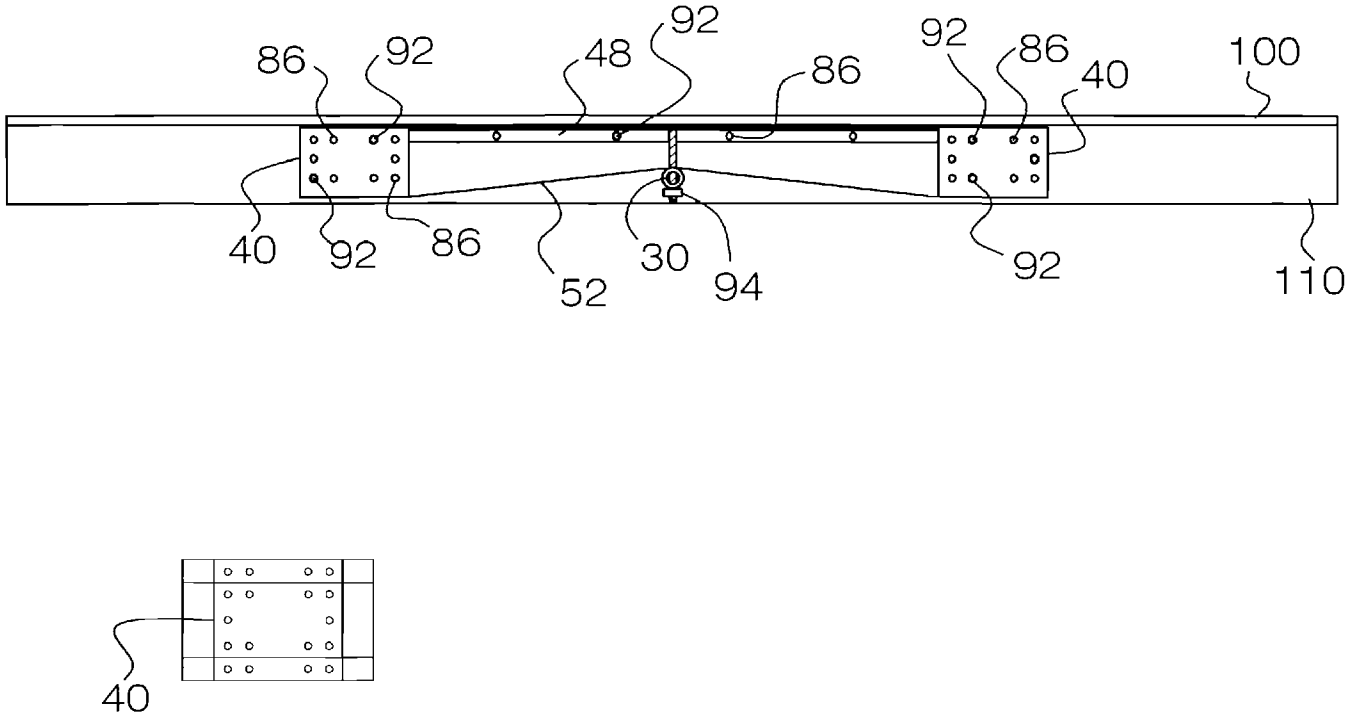
FIG. 12 is a lateral elevation view of another embodiment of the Modular Integrated system installed on a joist.

FIG. 12 illustrates an additional alternate embodiment of the Modular Integrated system 10B using a tensioning strap 52. The horizontal compression member 48 is positioned between the two spaced apart rigid plates 40 and fastened through holes 86 with fasteners 90 to the joist 110. The alternate rigid plates 40 are without receivers 42 and are fastened to the joist 110. The rigid plates 40 abut the horizontal compression member 48 at opposite ends. Each opposing rigid plate 40 is fitted with the tensioning strap 52 connecting one bottom edge of one rigid plate 40 to the other rigid plate's 40 bottom edge. The tensioning bolt 22 is affixed to the horizontal compression member 48. The end of the tensioning bolt 22 opposite the horizontal compression member 48 is passed through the tensioning strap 52. The nut 94 is tightened against the pipe washer 30 to pre-tension the joist 110. The rigid plates 40 of this embodiment are fabricated in such a way that they form a shallow box. The bottom edge of the box is attached to the tension strap 52 while the side and top edges of the box add rigidity. The Modular Integrated system 10B is designed for use in basements or multiple-story applications where preserving space below the floor joist 110 is critical for headroom considerations. It is also ideal for garage door headers or other spanning applications where sagging may be a concern. The Modular Integrated system 10B is configured with multiple design elements so that pre-existing features such as water pipes, wires, ducts, etc. can be avoided. At the same time, the modular design allows for easier handling and installation.

Figure 13:
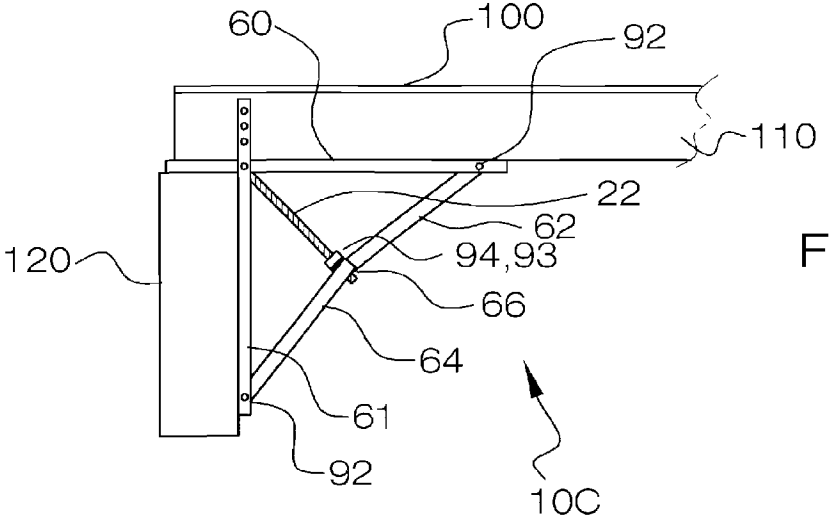
FIG. 13 is a lateral elevation view of the Corner Brace system embodiment installed at the juncture of a floor/subfloor and wall.
Figure 14:
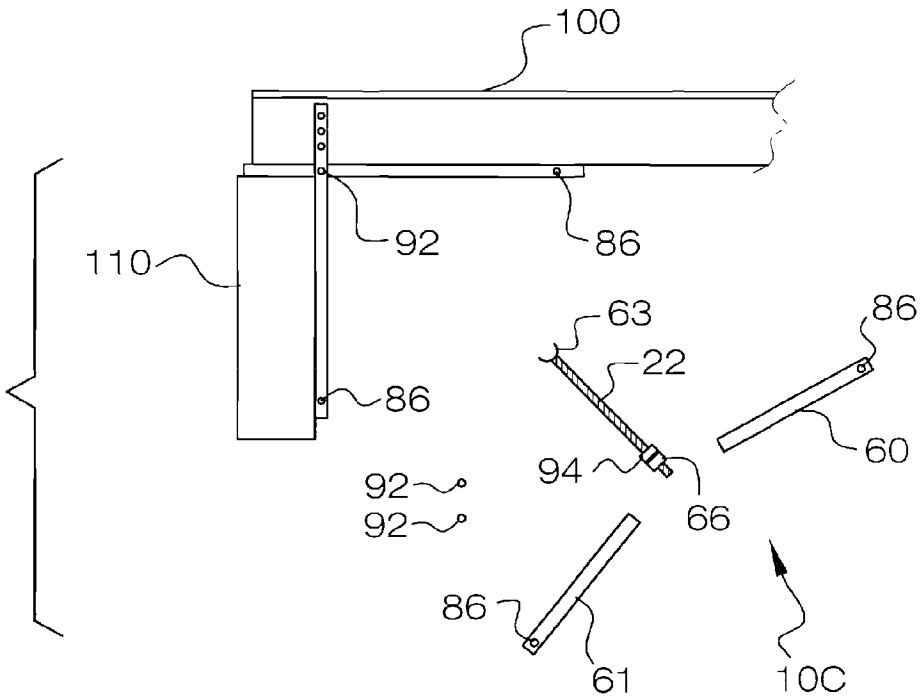
FIG. 14 is lateral elevation view of the Corner Brace system of FIG. 13, in the beginning installation phase.

FIG. 13 illustrates the Corner Brace system 10C embodiment. The Corner Brace embodiment applies the pre-tensioning system to corners needing pre-tensioning. An ideal example of the Corner Brace system 10C embodiment is utilized in the meeting of a joist 110 with a foundation or basement wall 120. The Corner Brace 10C embodiment allows near indefinite stiffness of the foundation wall 120 to be transferred out along the joist 110 for a distance from the wall 120, providing two major benefits. First, the floor 100 area directly over the Corner Brace 10C is greatly stiffened, whereby furniture and other heavy items are securely supported by the floor 100 above the joist 110. Second, the effective span of the floor joist 110 is reduced, which increases the overall stiffness of the entire floor 100. The Corner Brace system 10C comprises a joist brace 60 u-channel that is positioned along the bottom of a joist 110. A wall brace 61 u-channel is positioned along an adjacent wall 120, such as a basement wall 120 or foundation 120 that is perpendicular and below the joist 110. The joist brace 60 and the wall brace 61 are perpendicularly joined by a hinge bolt 92 where the joist 110 and wall 120 meet. Another hinge bolt 92 is disposed on opposite outer ends of each of the joist brace 60 and the wall brace 61. An upper extension of the wall brace 61 extends beyond and above the junction of the joist brace 60 and the wall brace 61 onto the joist 110. Fasteners 90 are used to attach the extension of the wall brace 61 to the joist 110. One end of a hat track upper brace 62 is pivotally attached to the hinge bolt 92 at the outer end of the upper brace 62. One end of a hat track lower brace 64 is pivotally attached to a hinge bolt 92 at the outer end of the wall brace 61.

Opposite ends of the upper brace 62 and lower brace 64 are then fitted over an allthread tensioning bolt 22 via holes 86 in each. The allthread bolt 22 is first fitted with a nut 94 and a washer 93. The bolt 22 tensions against the upper brace 62 and lower brace 64 via the compression flange 66. The allthread tensioning bolt 22 further comprises a half circle cup 63 on an end opposite the upper brace 62 and lower brace 64 fit. The cup 63 fits against the hinge bolt 92 which joins the joist brace 60 to the wall brace 61. Extending the nut 94 against the washer 93 forces the upper brace 62 and lower brace 64 outwardly. Outward pressure on the upper brace 62 and lower brace 64 pre-tensions the junction of the floor joist 110 and wall 120, thereby stiffening the same.

This Corner Brace system 10C is particularly effective for preventing floor 100 deflections for the first several feet from a wall 120. This deflection prevention is important for situations where tall furniture, such as a cupboard or display cabinet may be prone to rattle or rock when the floor 100 is loaded.

Figure 15:
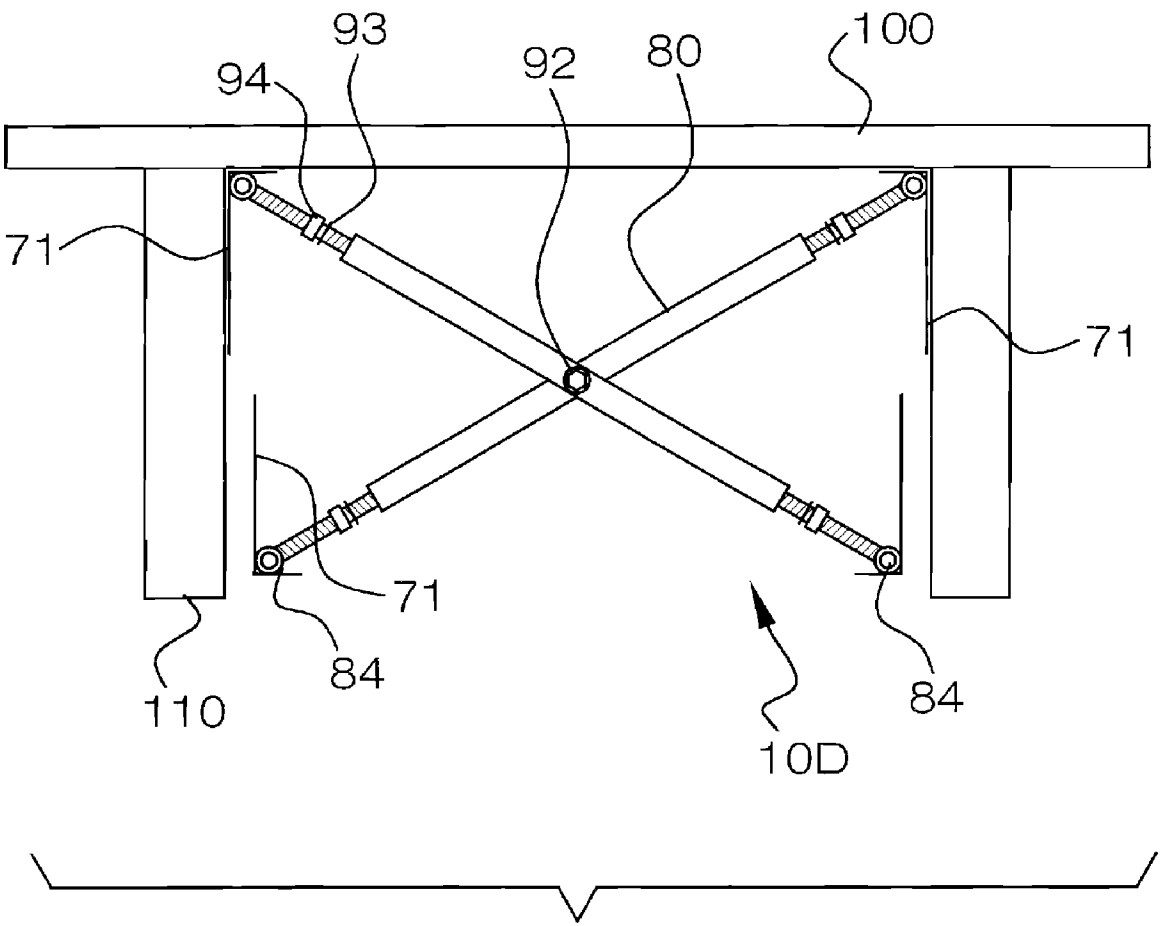
FIG. 15 is a lateral elevation view of an embodiment of the X-Press truss system in process of installation to adjacent floor joists and floor/subfloor.
Figure 16:
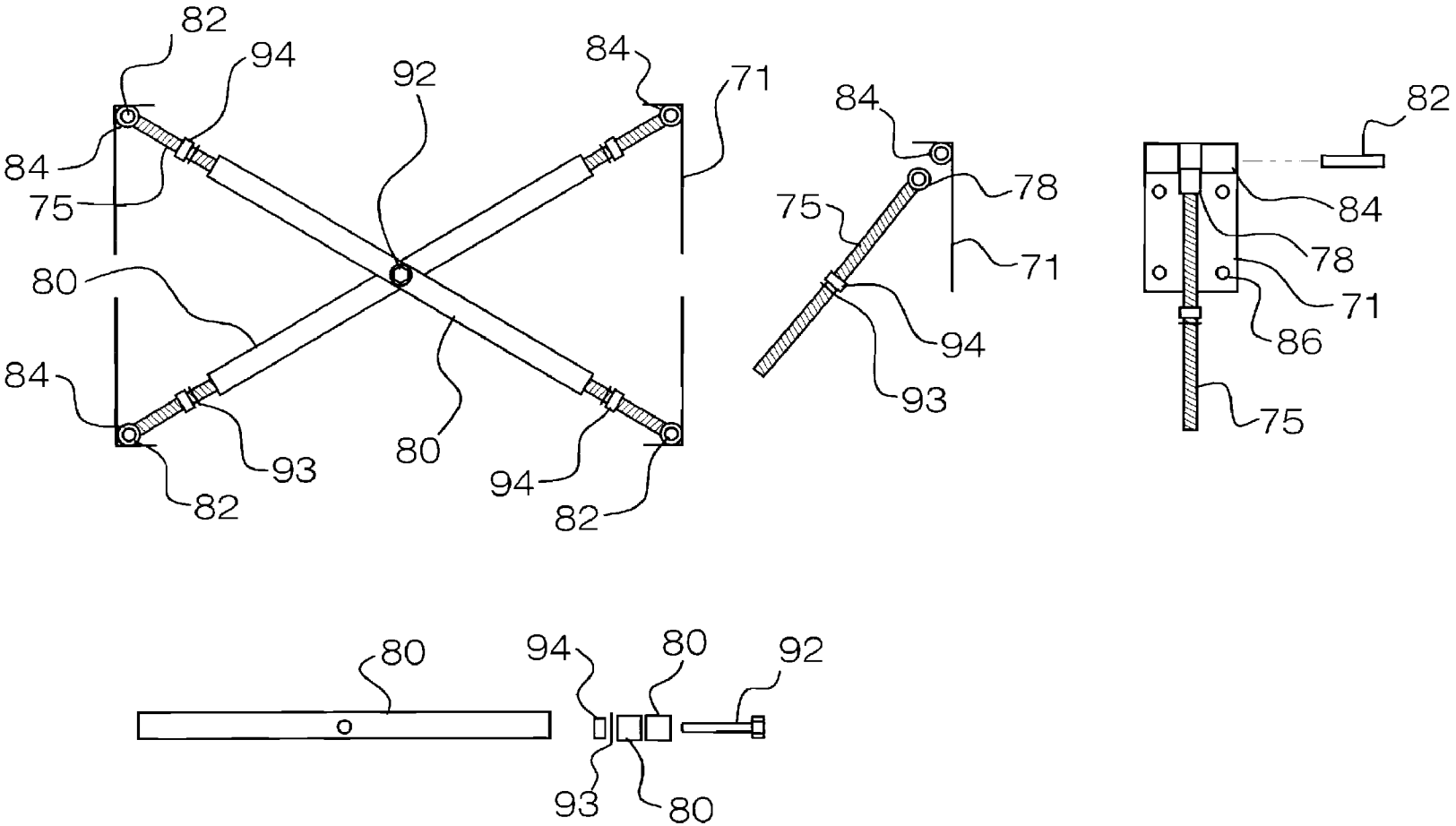
FIG. 16 is a view of some of the components of the X-Press embodiment if the system.
Figure 17:
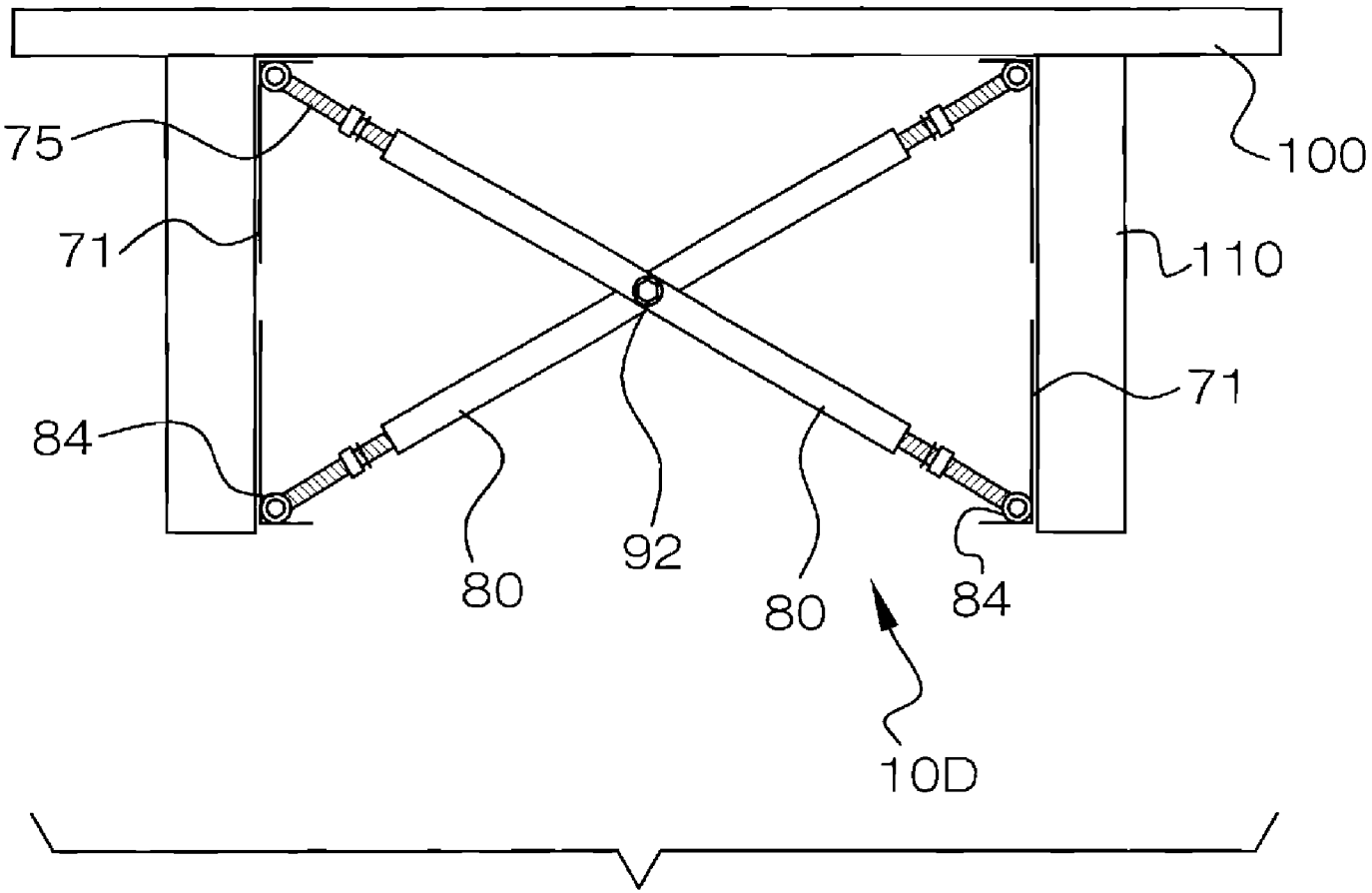
FIG. 17 is a lateral elevation view of the X-Press embodiment of FIG. 15, installed to adjacent joists and floor/subfloor.

Referring to FIGS. 15, 16, and 17, an additional embodiment of the joist stiffening system 10 is referred to as the X-Press system 10D. The X-Press system 10D embodiment of the system 10 offers joist 110 stiffening that does not extend below the level of a floor joist 110. As with the other embodiments of the floor joist stiffening system 10, the X-Press system 10 D pre-tensions joists 110, thereby eliminating lag in the stiffness response to forces applied to the floor 100. The X-Press system 10D locates all system components between separate spaced apart, adjacent floor joists 110.

The X-Press system 10D works with most joist 110/spacing combinations, such as 2"×12" joists 110 on 12" centers, 2"×8" joists 110, 2"×10" joists 110, and 2"×12" joists 110 on 16" centers, and even wider spaced apart joists 110. Wider spacing of joists 110 requires only the addition of a short joist 110 section between existing joists 110. The X-Press system 10D transverse stiffening applies a force substantially perpendicular to the floor joists' 110 heights, therefore laterally. Stiffening is realized by transferring joist 110 deflection to adjoining joists 110, as well as reducing effective joist 110 span. Installation is possible by a single installer. Only the basic tools 130 of glue, screwdriver, and a wrench are needed. Further, the X-Press system 10D accommodates I-beam type joists 110. The X-Press system 10D requires only that shims be fitted between the X-press right angle mounts 71 and the narrower section of the I-beam joists 110. The X-Press system 10D comprises right angle mounts 71 which are positioned proximal to the tops and bottoms of adjacent joists 110. The top mount 71 is positioned against the floor/subfloor 100. Holes 86 provide for fastener 90 use. Each mount 71 further comprises a pin receiver 84. A gap in the pin receiver 84 provides for insertion of the collar 78 disposed at one end of each bracket allthread 75. The pin 82 thereby provides for swiveling connection of the collar 78 and the pin receiver 84.

Figure 18:
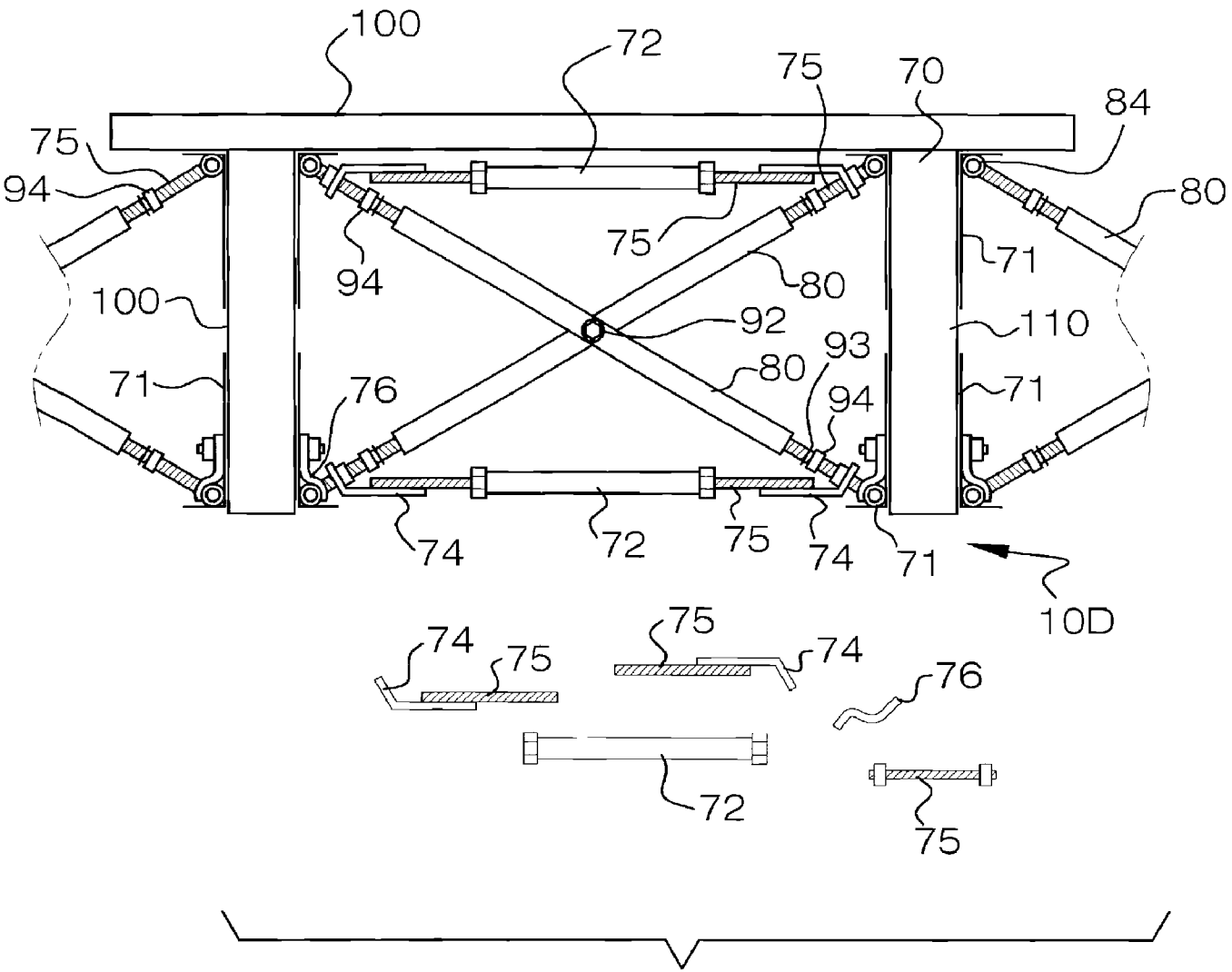
FIG. 18 is a lateral elevation view of an alternate embodiment of the X-Press embodiment of the joist stiffening system, installed on a floor/subfloor and joists.

Referring to FIG. 18, the X-Press system 10C can also be augmented by the optional turnbuckle assemblies 72 which further increase lateral tension between joists 110. Addition of the turnbuckle assemblies 72 uses connect brackets 74 to connect turnbuckle assemblies 72 to the bracket allthreads 75.

An S-bracket 76 is used at each such connection. The S-bracket 76 fits over the bracket allthread 75 and against the collar 78 and against the right angle mount 71. Each S-bracket 76 is bolted against either a joist 110 or a right angle mount 71 against a joist 110. Ideally, a turnbuckle assembly 72 is used at the top and bottom of the joists in the augmentation of the X-Press system 10D.

I claim:

1. A stiffening system for stiffening a joist member, a beam member and a truss member, the member stiffening affected by adjustable pre-tensioning, the system comprising:

a pair of struts;

a forming bracket fastened to each end of the struts, the forming bracket having an attachment end;

a tensioning bolt extending through the forming bracket at one end;

a triangulated bracket attached to each end of the struts opposite the forming bracket attachment end to be attached to a joist member;

a pipe washer attached to the tensioning bolt at an end opposite the forming bracket attachment end, the pipe washer having an attachment end;

a strap secured by the tensioning bolt and the pipe washer at the pipe washer attachment end of the tensioning bolt; and a nut threadly attaches to the tensioning bolt to secure the pipe washer to the tensioning bolt at the pipe washer attachment end.

* * * * *